United States Patent [19]

Moffitt, Jr.

[11] 4,372,700

[45] Feb. 8, 1983

[54] SUCTION PUMP RESERVOIR BRUSH

[76] Inventor: Merritt L. Moffitt, Jr., 9 Weirwood Rd., Radnor, Pa. 19087

[21] Appl. No.: 276,847

[22] Filed: Jun. 24, 1981

[51] Int. Cl.[3] ..... A46B 11/04

[52] U.S. Cl. ..... 401/157; 401/138; 401/189; 401/277; 15/341

[58] Field of Search ..... 401/138, 140, 157, 189; 15/341

[56] References Cited

U.S. PATENT DOCUMENTS

| | | | |
|---|---|---|---|
| 1,634,618 | 7/1927 | Hjorth | 401/157 |
| 1,953,940 | 4/1934 | Kingman | 401/189 |
| 2,391,385 | 12/1945 | Boral | 401/189 |
| 3,261,367 | 7/1966 | Pickering | 401/287 |

FOREIGN PATENT DOCUMENTS

| | | | |
|---|---|---|---|
| 17386 | 12/1929 | Austria | 15/341 |
| 279982 | 11/1914 | Fed. Rep. of Germany | 401/157 |
| 645016 | 5/1937 | Fed. Rep. of Germany | 401/138 |
| 633676 | 2/1928 | France | 132/84 R |
| 2809 | of 1913 | United Kingdom | 15/341 |

*Primary Examiner*—Clyde I. Coughenour
*Attorney, Agent, or Firm*—John J. Simkanich

[57] ABSTRACT

A reservoir brush useful for washing automobiles and the like has a vacuum creating pump operable in a chamber in which an expandable bladder resides in order to draw fluid through the head of a brush to which the bladder is attached and into the bladder, wherein the chamber is vented, facilitating collapse of the bladder and run-out of the fluid when the pump is not operating, the pump including a check valve facilitating the pumping action.

3 Claims, 5 Drawing Figures

SUCTION PUMP RESERVOIR BRUSH

BACKGROUND OF THE INVENTION

This invention relates to utility brushes, and more particularly, to utility brushes including an integral reservoir for holding a supply of cleaning fluid.

The cleaning of various objects, for example, cars or other motor vehicles, requires the use of a brush and cleaning fluid such as soapy water. Normally the soapy water is retained in a bucket and the cleaning brush is dipped into the bucket, absorbing the soapy water. The brush is then placed on the vehicle, allowing the soapy water to run onto the surface of the vehicle to be cleaned by the brush. This technique is time-consuming, as only a small amount of the soapy water is retained on the brush bristles, causing the brush to be continually dipped into the bucket.

Reservoir brushes have been taught by Wilson, U.S. Pat. No. 2,517,152, and Fletcher, U.S. Pat. No. 3,119,142. Both of these brushes contain a fluid-holding reservoir and a passageway through the head of the brush to the area of the brush bristles which allows for an emptying of the reservoir while the brush is being used. The brushes of Wilson and Fletcher, however, are filled by removing a cap in the back of the head of the brush or on top of the reservoir. This filling procedure is time-consuming and cumbersome and undesirable in car washing applications.

Whitehous, U.S. Pat. No. 946,832, and Lundin, U.S. Pat. No. 984,098, teach hand-operated vacuum cleaners for cleaning dust from carpets and the like. Cellini, U.S. Pat. No. 4,094,031, teaches a hand-operated vacuum cleaning device for swimming pool bottoms. Each of these devices as taught by Whitehous, Lundin and Cellini includes a complicated operating structure including the necessity for an intake check valve which assures that any fluid or dust particles drawn into the device does not escape through the incoming pathway. The designs as taught by Whitehous, Lundin and Cellini do not contemplate the use of a suction pump as a filling means for a reservoir brush. Moreover, by the very nature of their complicated structure, their devices would have cost-prohibitive manufacturing costs when directed toward the automobile accessory market for cleaning brushes.

What is desired is a suction pump reservoir brush of simple and durable design which would be relatively economical to manufacture and which would be easily operated to quickly fill the reservoir of the brush providing a soapy water dispensing brush for cleaning automobiles.

An object of this invention is to provide a fluid-dispensing reservoir brush having a suction pump operation for readily filling the reservoir.

Another object of this invention is to provide such a brush with a fluid-containing membrane for holding the fluid within the reservoir chamber separate from vacuum creating mechanisms within that reservoir chamber.

Another object of this invention is to provide such a reservoir brush where the discharge rate of fluid from the reservoir membrane onto the brush bristles may be adjustably controlled.

A further object of this invention is to provide a simplified vacuum pumping mechanism, including a simplified construction for the vacuum creating piston and check valve operation associated therewith.

An even further object of this invention is to provide a venting of the vacuum chamber when the vacuum pump is inoperative, this venting assisting in the collapse of the fluid-holding membrane and assuring an even and steady flow of the fluid out of the brush.

SUMMARY OF THE INVENTION

The objects of this invention are realized in a suction pump reservoir brush useful in washing automobiles and the like, which brush provides a steady flow of cleaning fluid such as soapy water through the brush head for a period of time while the brush is in use and until the reservoir has emptied.

A cleaning brush has a chamber connected to the non-cleaning side of the head thereof. This chamber is connected to the cleaning side of the brush through a passageway containing a metering mechanism. Positioned within the chamber in order to fill from and empty into the passageway is a fluid-holding membrane. This membrane is capable of holding the cleaning fluid such as soapy water and expanding or collapsing as the volume of water taken into the chamber through the passageway increases or decreases as it empties out through the passageway. This membrane keeps the fluid from coming in contact with objects operating in the chamber.

A spring biased, rod-actuated, vacuum generating piston operates within the chamber outside the membrane-passageway connection. This piston includes a disk having a canted peripheral skirt, the disk operating in conjunction with a vented head upon which it is mounted for providing a closed valve function during the vacuum stroke, and a venting function during the priming stroke of the suction pump, thereby reducing the pressure on the chamber during the primary stroke.

A chamber vent is provided at a location for venting the chamber when the vacuum creating piston structure is in its inoperative position.

DESCRIPTION OF THE DRAWINGS

The novel features, structure and advantages of this invention will be readily understood from a reading of the following detailed description of the invention, in conjunction with the attached drawings, in which like numerals refer to like elements, and in which.

DETAILED DESCRIPTION OF THE INVENTION

Figure 1:
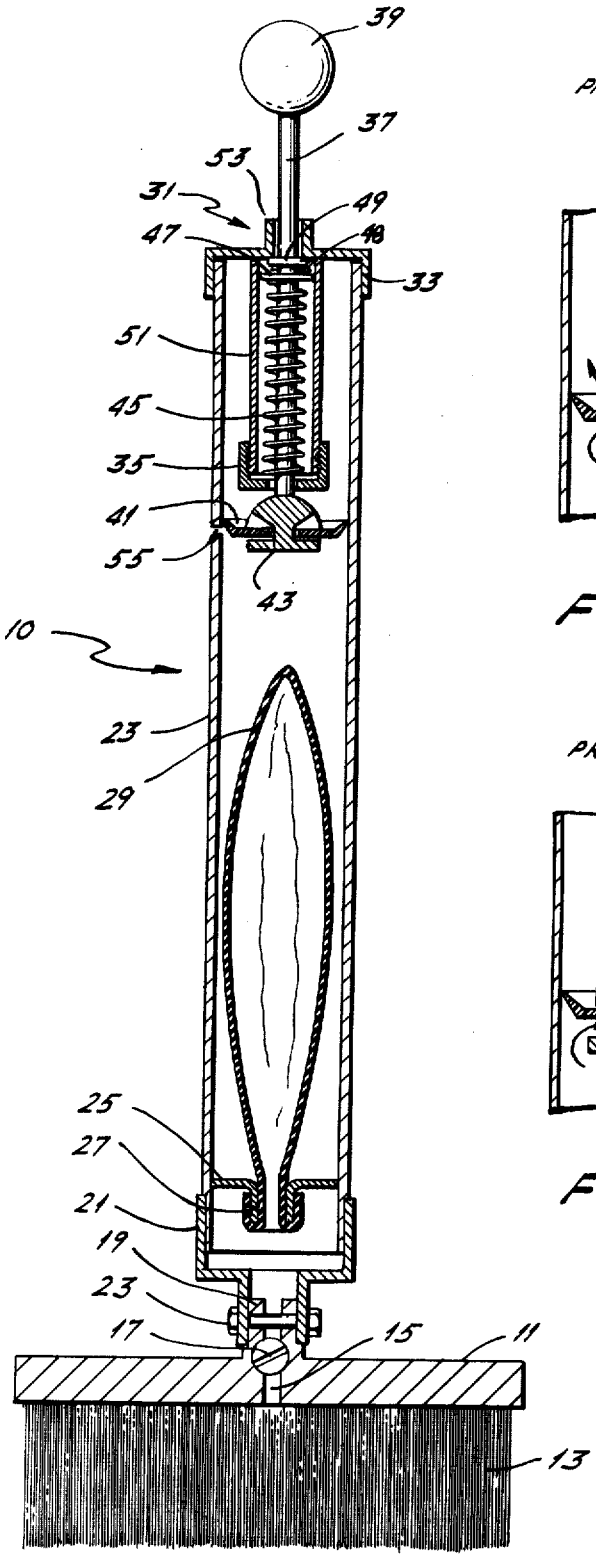
FIG. 1 shows a cross sectional view of the assembled suction pump reservoir brush of the present invention.

A suction pump reservoir cleaning brush 10, FIG. 1, includes a brush head 11. Mounted on one side of this brush head 11 is a cleaning implement, such as the bristles 13. As an alternate to the bristles 13 a sponge or other cleaning structure can be substituted for brushing soil from surfaces. A passageway 15 extends through the head 11 of the brush from the area of the bristles 13. This passageway 15 can extend directly through the brush head 11 as shown in FIG. 1, or may traverse to another area via an alternate path such as extending around the brush head 11 or on a diagonal through the brush head 11.

A metering screw 17 or other adjustable valve member is positioned in the passageway 15. This metering screw 17 is adjustable to alter the opening through the passageway 15 at the location of the screw 17, and thereby control the rate of flow.

Extending away from the back of the brush head 11, as a continuous structure thereof, is a mounting collar 19. The passageway 15 extends from the working or bristle 13 side of the head 11 through this collar 19.

A step down tubular coupling 21 has its smaller diameter end connected to the collar 19, with this end inserted over the outside of the cylindrical collar 19. A bolt 23 is used to hold the step down coupling 21 on the collar 19. This bolt 23 is positioned so as not to interfere with the operation of the passageway 15. The step down tubular coupling 21 forms a square shoulder where it changes from its smaller diameter portion to its larger diameter portion.

A cylindrical or tubular chamber 23 is attached to the larger diameter portion of the coupling 21 by inserting this chamber 23 into the large end of the coupling 21 in a sealing engagement by gluing or otherwise fusing the materials together.

Positioned at the coupling 21 end of the chamber 23 is a partition 25 extending completely across the chamber. This partition 25 is positioned away from the end of the chamber 23 and has a circular opening in the center thereof with a collar 27 extending about this opening and toward the coupling 21.

A pliable membrane 29, such as a collapsible balloon, is attached to the partition collar 27 and extends into the chamber 23 through the circular opening in the partition 25. This balloon 29 has its open end stretched over the outside of the partition collar 27 to be frictionally attached thereto. A series of annular knurls extending about the outside of this collar 27 aid in the frictional attachment of the balloon 29 to this partition collar 27.

A piston subassembly 31 is attached to the other end of the cylindrical chamber 23. This piston subassembly 31 includes an outside cap member 33, an inside cap member 35, an actuating rod 37 with hand grip ball 39, a disk-shaped piston 41 held to the rod 37 by a fitting or mounting head 43, an initial (or inactive) position biasing spring 45 with a spacer washer 47, a cotter pin 48 and a snubber ring 49.

The outside cap member 33 is mounted to abut to the end of the chamber 23 and completely close off that end of the chamber 23. It includes a cylindrical collar or skirt which screws onto the outside of the chamber 23 or is otherwise glued or sealed to the outside wall of the chamber 23. An inner tube 51 is formed as part of the outside cap member 33 and extends into the chamber 23 concentrically about the center line of that chamber 23. This inner tube 51 is threaded on its free end for receiving the inside cap member 35.

Inside cap member 35 has an opening in the center thereof through which the actuating rod 37 extends to operate. This hole in the center of the inside cap member 35 is positioned concentrically about the center line of the chamber 23 and inner tube 51.

The outside cap member 33 also has an outside collar 53 which extends outwardly a short distance to provide a sliding support for the actuating rod 37 which extends therethrough. This collar 53 is circular in shape and is positioned about the same center line axis as the inner tube 53 and the inside cap member 35.

Actuating rod 37 extends through the outside collar 53 and through the inside cap member 35 with its hand grip ball 35 being on its outside end.

The operation of the actuating rod 37 is supported by its sliding contact with the inside of the outside collar 53 and the side of the opening in the inside cap member 35.

The snubber ring 49 extends about the actuating rod 37 at the inside face of the outside cap member 33 and adjacent to the area of outside collar 53. The snubber ring 49 is held in place against the inside face of that outside cap member 33 by the cotter pin 48, washer 47 and the operation of the spring 45. Cotter pin 48 extends through the rod 37 at a location between the snubber ring 48 and the washer 47. Spring 45 extends about the actuating rod 37 from the washer 47 to the inside face of the inside cap member 35.

The inner end of the actuating rod 37 is threaded. Attached to this threaded end is the fitting or mounting head 43 which has a threaded receiving hole as a part thereof. Positioned on this mounting head 43 is the disk-shaped piston 41 which comes in contact with the inner wall of the cylindrical chamber 23.

A small vent hole 55 extends through the wall of the cylindrical chamber 23 at a position slightly to the collapsible balloon 29 side of the disk-shaped piston 41 when the actuating rod 37 is inoperative and moved to its initial position by operation of the spring 45 force.

Figure 2:
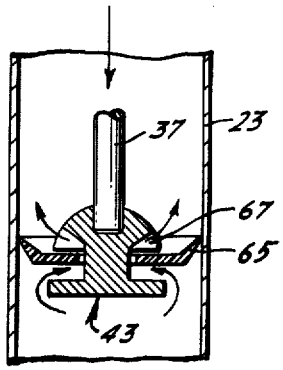
FIG. 2 shows the priming stroke operation of the suction pump piston showing the vented head or fitting to which the wiper disk is mounted during the priming stroke.
Figure 3:
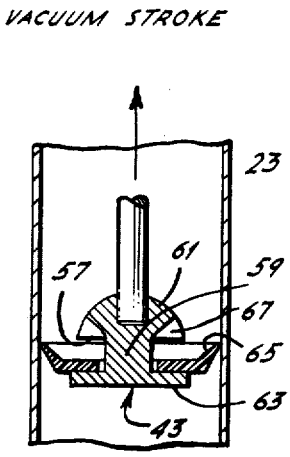
FIG. 3 shows the vacuum stroke of the acorn-shaped vented head of FIG. 3 in operation during the vacuum stroke.

The mounting head 43, FIGS. 2 and 3, has a rounded shape as it meets the actuating rod 37 much like a ball or acorn. This shape is truncated to form a flat wall 57 of toroidal shape which extends perpendicular to the axis of the actuating rod 37. A cylindrical projection 59 from the center of the hemispherical or rounded portion 61 of the mounting head 43 extends from the center of the toroidal wall 57 and ends in a flat disk portion 63 of the mounting head 43.

The disk-shaped piston 41 is mounted on the head 43 by slipping it over the hemispherical or rounded portion 61. This piston 41 operates in the space defined by the length of the cylindrical projection 59 between the hemispherical portion 61 and the flat disk portion 63 of the head 43.

This piston 41 has a center hole or opening which is smaller than the diameter of the hemispherical portion 61 but larger than the diameter of the cylindrical projection 59.

The disk-shaped piston 41 has a canted peripheral skirt 65 which extends about the circumference of the flat portion of the disk 41 and projects toward the activating rod 37 end of the head 43. This skirt 65 maintains an intimate contact with the inner wall of the cylindrical chamber 23 having a slight frictional contact therewith during the priming stroke, FIG. 2, and a more severe frictional contact therewith during the vacuum stroke, FIG. 3. During this vacuum stroke, FIG. 3, the skirt 65 tends to spread against the inside wall of the chamber 23 creating a seal thereagainst as well as forcing the disk portion of the piston 41 to seat against the flat disk portion 63 of the head 43 creating a seal thereby.

During the priming stroke, FIG. 2, the frictional force of the peripheral skirt 65 against the inside wall of the chamber 23 moves the disk piston 41 against the toroidal wall 57. A plurality of air slots 67 are cut into the hemispherical portion 61. These air slots 67 extend from the outside surface of the hemispherical portion 61 to the wall of the cylindrical projection 59 and enable a passage of air through the space caused by the oversized opening in the disk-shaped piston 41 center hole, past the cylindrical projection 59 and out through the air slots 67.

Figure 4:
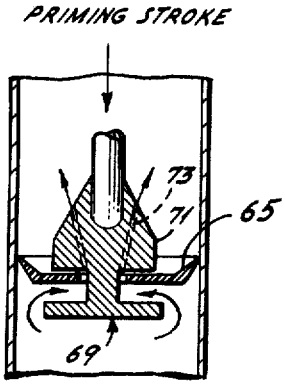
FIGS. 4 and 5 show the priming stroke and vacuum stroke operation, respectively of the vacuum creating piston of FIGS. 2 and 3 in an alternate embodiment for the shape of the head and its integral vent openings.
Figure 5:
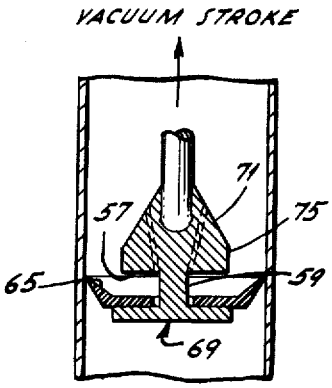

FIGS. 4 and 5 show the priming and vacuum strokes, respectively, and operation for an alternate embodiment for the mounting head 43 of FIGS. 2 and 3. Alternate mounting head 69 is identically shaped to the mounting head 43 except as to the shape of the hemispherical portion 61 and air slots 67 of that first embodiment. In the embodiment shown in FIGS. 4 and 5, the threaded end of the actuating rod 37 is secured to a truncated conically-shaped portion 71 having a plurality of air passageways 73 extending from the conical face to the inner base of the toroidal flat wall 57 where it meets a similar cylindrical projection 59 extending from the conical portion 71. The conical portion 71 can have a short section which is cylindrically-shaped and which is located directly adjacent to the flat toroidal wall 57. This cylindrical section 75 establishes a limit to the lateral projection of the conically-shaped portion 71. In operation, the embodiment of FIGS. 4 and 5 functions identically to the embodiments of FIGS. 2 and 3.

The invention at hand affords a design which is simple to manufacture and assemble, it having a minimal number of parts; and which is sturdy and durable and which does not become clogged or coated with residue from the dirty soapy wash water taken into the reservoir.

The invention is assembled by first assembling the disk 41 over the hemispherical or conical portions 71, respectively, of the various embodiments. The disk-shaped piston 41 is made of rubber, nylon or other pliable material which will expand slightly and stretch in order to slide into position against the flat disk portion 63 of the head 43. The activating rod 37 is then inserted through the outside collar 53 and the seal 49, along with the washer 47, are assembled onto this rod 37. The spring 45 is then inserted onto the rod and the inner cap 35 is then screwed onto the inner tube 51. The actuating rod 37 is then screwed into the head 43. This subassembly 31 is then mounted onto the end of the chamber 23. The collapsible balloon 29 is stretched over the partition collar 27 and inserted into the chamber 23. The chamber 23 is then inserted into the larger diameter portion of the step down coupling 21. It is desirable that both the piston assembly 31 and the step down coupling 21 be removable from the end of the chamber 23 in order to enable replacement or repair of the piston 41 and the collapsible balloon 29, respectively. The assembly is then attached to the brush head collar 19 and the flow rate for fluid adjusted by the metering screw 17.

Many and various materials may be used in manufacturing the invention. Typically the brush head 11 with its collar 19 is made of wood or plastic or other similar material. The collar 21, chamber 23, outside cap 33, inside cap 35, mounting head 43, actuating rod 37, hand grip ball 35, and chamber partition 25 with collar 27 can be made of metal such as light sheet metal or plastic, nylon, fiberglass or other materials. Most commonly, the disk-shaped piston 41 is made of rubber, neoprene, nylon or plastic or other suitable, pliable material. The seal 49 can be a rubber or nylon O-ring while the spring 45 and washer 47 are made of metal.

The fluid-containing membrane, i.e., the collapsible balloon 29 of plastic or rubber, keeps the hot soapy water which is carried into the chamber 25, away from the actuating mechanism of the piston subassembly 31. This keeps the hot soapy, and often dirty and grit-bearing water, away from the vacuum creating mechanism. The vacuum subassembly 31 and its operation against the chamber 23 can be properly maintained and lubricated for the extended working life of the mechanically working parts thereof. Thereby the operation of the piston 41 and its operation against the walls of the chamber 23 is greatly enhanced for extended working life. A proper lubricant may be used in the vacuum chamber without the worry that it would be washed out by the soapy water carried into the chamber.

In operation, the actuating rod 37 is vigorously pumped, creating a vacuum in the chamber adjacent to the collapsible balloon 29. This is effected by the combination operation of the piston 41 operating in connection with the vented head 43 and the unique shape thereof to cause a single check valve operation, eliminating the necessity of multiple check valves. The vent hole 55 is positioned directly adjacent to the peripheral skirt 65 of the piston 41 when it is in the fully retarded or initial position. Thereby, the reservoir end of the chamber 23 is subjected only to a vacuum or negative pressure as long as the actuating rod has been operated and the rod is slightly depressed so that the vent 55 through the wall of the chamber 23 is on the opposite side of the sealing piston 41. Typically when the actuating rod 37 is stopped during a vacuum stroke, the wiping action of the peripheral skirt 65 against the inner wall of the chamber 23 will force the piston 41 against the respective flat disk portions 63 of the heads 43, 69, creating a seal at that member. As long as this seal and, therefore, vacuum is maintained above the collapsible balloon 29, the balloon will hold whatever water or fluid has been drawn into it. Once the actuating rod is fully returned to its initial position, the vent 55 allows a small amount of air to enter the chamber, breaking the vacuum and permitting a runout of water or fluid from the balloon 29 through the metered passageway 15.

Many changes can be made in the above-described suction pump reservoir brush without departing from the intent and scope thereof. Therefore, it is intended that all matter contained in the above description and shown in the accompanying drawings be interpreted as illustrative and not be taken in the limiting sense.

What is claimed is:

1. A suction pump reservoir brush apparatus, comprising:

bristle means for brushing soil from surfaces;

a support head for holding said bristle means, said head having a passageway therethrough connected to open at said bristle means;

a cylindrically-shaped chamber connected to said passageway and a portion of said support head away from said bristle means;

a cap enclosing the free end of said chamber away from said support head;

an actuating rod extending through said cap;

a disk-shaped piston including a peripheral skirt canted in sealing engagement with said chamber and on the end of said rod within said chamber, having a hole therethrough and a mounting head attached to said rod end having a first portion with air passageways against which said piston seats during a priming stroke, a second portion about which said piston is positioned and a third portion against which said piston seats during a vacuum stroke;

said piston having an initial inoperative position at said cap end of said chamber;

a small vent hole through the wall of said chamber near the inactive position of said piston and on the support head side thereof;

a flow regulating screw valve extending through said support head passageway;

a partition across said chamber at said support head end, said partition having an opening therethrough;

a mounting surface connected to said partition extending about said opening forming a collar extending about said partition opening and toward said passageway; and a balloon-like membrane connected to said collar.

2. The apparatus of claim 1 wherein said balloon-like membrane is stretched over said collar and extends through said partition opening into said cylindrical chamber.

3. The apparatus of claim 2 also including:

a tube extending into said chamber from said cap, said activating rod extending through said tube;

an inside cap member closing off the inside end of said tube, said activating rod extending therethrough;

a spring held within said tube and inside cap enclosure biasing said activating rod to the inactive position; and a seal about said activating rod at its passage through said cap.

* * * * *